US005732411A

United States Patent [19]

Coleman et al.

[11] Patent Number: 5,732,411

[45] Date of Patent: Mar. 31, 1998

[54] ADJUSTABLE GUARD FOR THE LOWER LEG AND SHIN

[75] Inventors: W. Carl Coleman; Michael J. Kelly, both of Seattle; Diana J. Merritt, Redmond, all of Wash.

[73] Assignee: Trace Athletic Corporation, Seattle, Wash.

[21] Appl. No.: 627,490

[22] Filed: Apr. 4, 1996

[51] Int. Cl.[6] ..... A41D 13/00

[52] U.S. Cl. ..... 2/22; 2/24; 602/23

[58] Field of Search ..... 2/24, 22, 16, 453, 2/2; 602/23

[56] References Cited

U.S. PATENT DOCUMENTS

| | | | |
|---|---|---|---|
| 1,653,601 | 12/1927 | Foulke | 2/24 |
| 2,057,992 | 10/1936 | Wiruth | 2/24 |
| 2,484,494 | 10/1949 | Ferguson | 2/24 |
| 4,183,099 | 1/1980 | Lacey | 2/24 |
| 4,219,892 | 9/1980 | Rigdon | 2/24 |

*Primary Examiner*—Bibhu Mohanty

*Attorney, Agent, or Firm*—Jensen & Puntigam, P.S.

[57] ABSTRACT

An extendible leg protector which includes a lower protective portion for the foot and shin, an upper protective portion for the knee, and two adjustable portions which extend from the lower and upper protective portions, respectively. The adjustable portions are adapted to mate together in a manner that the total length of the protector can be varied.

7 Claims, 2 Drawing Sheets

ADJUSTABLE GUARD FOR THE LOWER LEG AND SHIN

TECHNICAL FIELD

This invention relates generally to protective guards, and more specifically concerns a protective guard which extends for the full length of the lower leg of the user, including the shin.

BACKGROUND OF THE INVENTION

Full length protective guards designed to protect the knee, leg and shin of a user are generally well known. Such protective guards are conventionally used, for instance, by catchers in softball and baseball, where protection of the entire lower leg is important. Other sports, such as hockey or activities such as in-line skating, benefit from use of such full length protective guards as well. Such guards, however, typically have a fixed length, so that teams usually require more than one set of the protective guards, if two different players require them, because of different lower leg lengths of the players. Accordingly, sporting goods stores must stock a variety of said protective guards, with different lengths, and manufacturers must manufacture more than one length of such guards. Further, even with a variety of lengths available, many players are still not fitted well.

DISCLOSURE OF THE INVENTION

Accordingly, the invention is an adjustable protective guard for legs, which comprises: a lower protective portion which typically covers the upper portion of the foot of a user; a first adjustable portion which is attached to the lower protective portion and extends therefrom, the first adjustable portion being configured and adapted to protect a lower portion of the leg of the user; an upper protective portion for the knee of the user; and a second adjustable portion which is attached to the upper protective portion and extends therefrom, wherein the first and second adjustable portions include, respectively, mating means permitting the two adjustable portions to be secured together at varying relative positions such that the length of the protective guard can be adjusted.

BEST MODE FOR CARRYING OUT THE INVENTION

Figure 1:
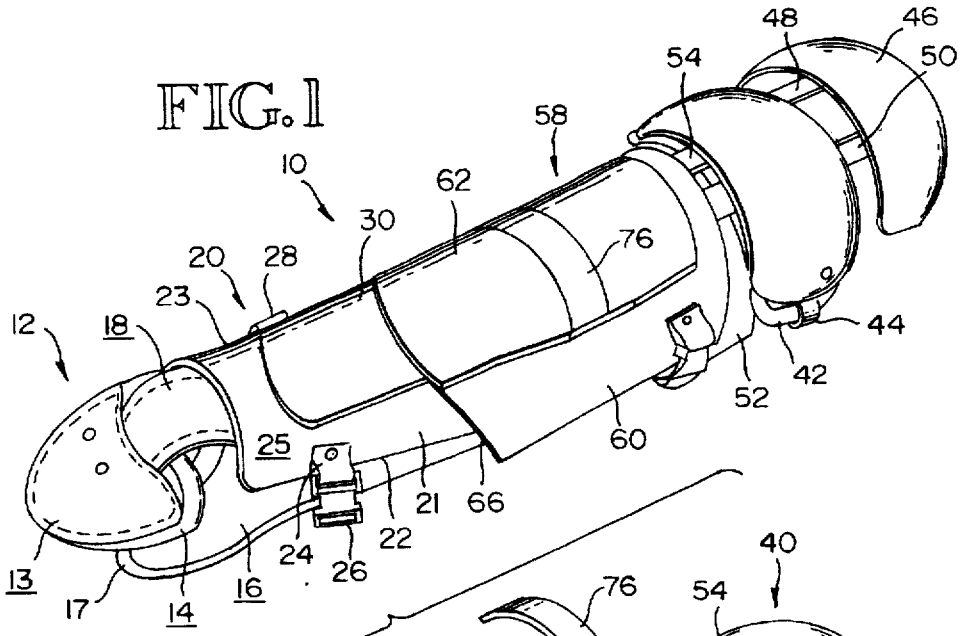
FIG. 1 is a perspective view showing one embodiment of the present invention.
Figure 2:
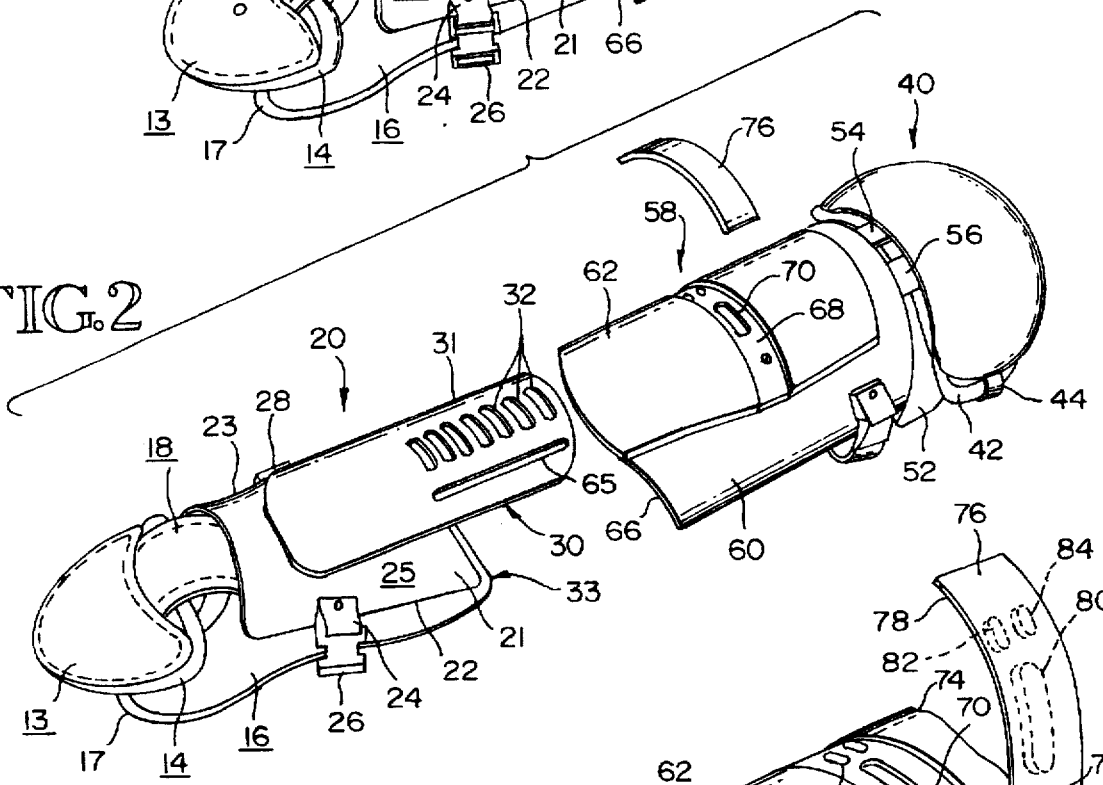
FIG. 2 is a perspective view showing in more detail the embodiment of FIG. 1.
Figure 3:
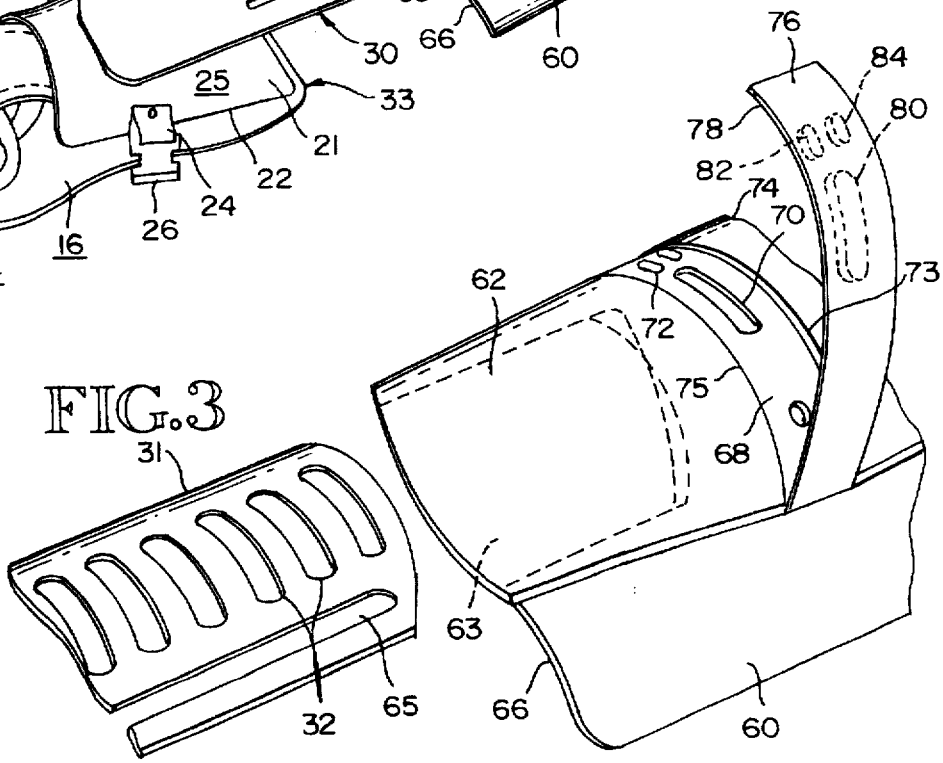
FIG. 3 is a partial perspective view of a portion of the embodiment of FIGS. 1 and 2.
Figure 4:
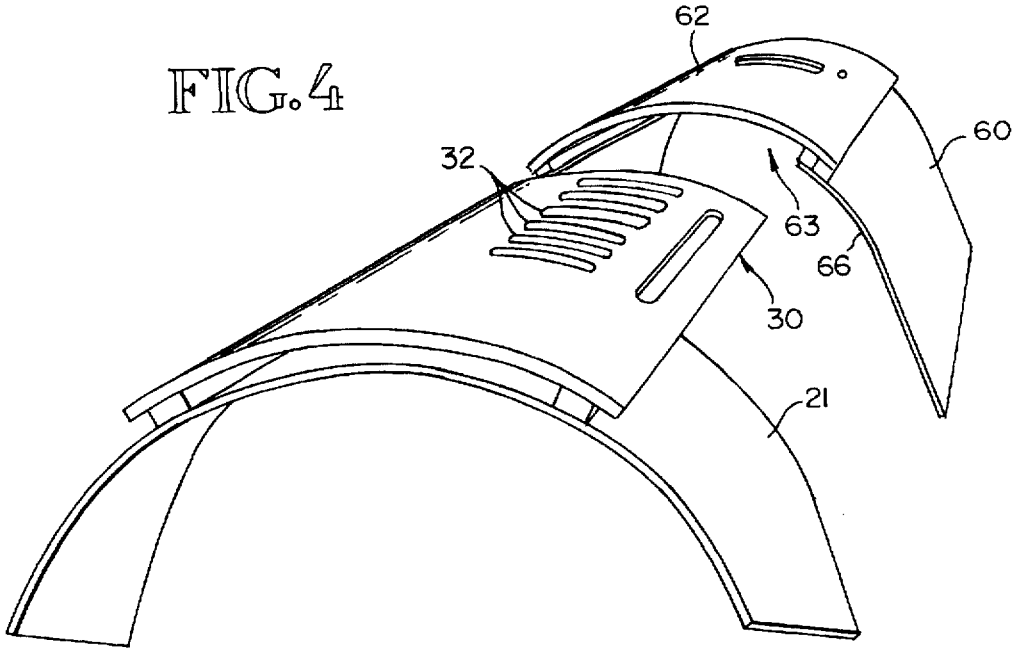
FIG. 4 is another partial perspective view showing a portion of the embodiment of FIGS. 1 and 2.

FIGS. 1–4 show a first embodiment of the present invention. As indicated above, the present invention is a protective guard which extends from the upper foot, ankle and shin of a user up and over the lower leg and then over the knee. A lower thigh protector may also be included. Such protective guards are commonly worn, for instance, as indicated above, by catchers in baseball. The protective guard of the present invention, however, is different from conventional full-length protective guards, as it includes a center sliding portion which is constructed to make the protective guard conveniently adjustable in length.

The extended protective guard shown generally at 10 includes a conventional ankle, shin and upper foot protector portion 12. A stiff plastic shield-shaped member 13, approximately 5 inches wide at its widest point and approximately 3 inches long, is the lowermost portion of the guard. Positioned behind the shield and riveted thereto is a foam pad 14 which extends slightly beyond the periphery of shield member 13. The shield and foam pad combination is connected to a lower extended protective foam pad 16 by means of a flexible strap 18, which in the embodiment shown is approximately 2 inches wide and 4 inches long. Foam pads 14 and 16 are both made with closed cell foam and have a cloth covering.

The lower extended protective pad 16 in the embodiment shown is approximately 11 inches from one side edge to the other and curves from side to side to fit around the lower portion of the leg from the ankle. The lower edge 17 of pad 16 is shaped so as to cover the shin bones on opposite sides of the foot and then around the top portion of the foot in the vicinity of the ankle. Protective pad 16 is approximately 8 inches long at its longest dimension, near the side edges thereof, and approximately 4 inches long at the center thereof.

Protective pad 16 is attached to a lower sliding adjustable section, referred to generally at 20. lower sliding section 20 is made from rigid ABS plastic approximately ⅛-inch thick. It could also be made from polyethylene or polypropylene, or other material which is resistant to penetration and can spread the shock of a hard blow.

Sliding section 20 includes a base portion 21 in the embodiment shown which is curved from side to side so as to fit around the lower leg of the user. The protective pad 16 curves from side to side, as discussed above, because it is attached to this curved base portion 21. In the embodiment shown, base portion 21 is approximately 6 inches long and is approximately 5 inches from side edge to side edge at its lower end and approximately 7 inches from side to side at its upper end. Attached to the base portion 21 in the vicinity of one side edge 22 thereof is an elastic strap 24 which includes a catch element 26 on the distal end thereof. The catch element 26 is adapted to mate with a latch 28 which is connected to the opposing side edge 23. The strap 24 is used to hold the protective guard to the leg of the user.

Attached to upper surface 25 of base portion 21 of the lower sliding section is a lower mateable portion 30. Mateable portion 30 is also made of ABS plastic or similar hard shell material. In the embodiment shown, lower mateable portion 30 is approximately 3 inches wide, slightly curved from side to side, and approximately 7 inches long. An upper part 31 of mateable portion 30 extends beyond upper edge 33 of base portion 21. In part 31 are a series of lateral slots or openings 32—32. In the embodiment shown, there are seven such slots, each of which is approximately 1-½ inches long by ¼-inch wide and spaced approximately ¼ inch apart.

At the upper end of the extendable guard 10 is a hard shell plastic knee protector element 40 and an inner foam pad 42 which is riveted thereto. The knee protector 40 is curved, i.e. partially spherical, to fit around and over the knee of the user. Attached to the opposing edges, respectively, of foam pad 42 are an elastic strap and catch 44 at one edge and a mating latch to the opposing edge. Extending from the top edge of the knee protector 40 is a lower thigh portion 46 which includes a hard plastic shell and a foam pad inner portion. The lower thigh portion 46 is connected to the knee portion by two spaced flexible straps 48 and 50. The opposing side edges of the lower thigh portion 46 have metal loops attached thereto, through which a strap can be drawn so as to secure the lower thigh portion to the user. The knee protector 40 and the lower thigh protector 46 are both conventional in design and construction.

Extending downwardly from the lower end of the knee protector 40 is an upper extended protective pad 2. In the embodiment shown, this protective pad is approximately 5-½ inches in length and is approximately 11 inches from side to side and also curves from side to side to conform to the leg portion of the user below the knee. Two spaced flexible straps 54 and 56 connect upper extended protective pad 52 to knee protector 40. Metal rivets connect the straps to pad 52.

Protective pad 52 is attached to an upper sliding adjustable section 58 which includes a base portion 60 and an upper mateable portion 62. Upper sliding section 58 is also made of stiff, shock resistant ABS plastic or comparable material. Base portion 60 is 8 inches long by 11 inches wide, and is curved to conform to the leg of the user. Protective pad 52 conforms to the inner surface of the base portion over a substantial portion of the length of the base portion, from an upper edge thereof.

In the embodiment shown, base portion 60 includes a rectangular opening 63 which extends inwardly of the base portion from a lower edge 66 thereof. Mateable portion 62 is secured to the upper surface of base portion 60. Mateable portion 62 is positioned slightly above the upper surface of base portion 60. Mateable portion 62 extends from the lower edge of base portion 60 nearly to the upper edge thereof and is secured along its respective longitudinal edges to the base portion. Mateable portion 62 covers opening 63, and is secured to base portion 60 slightly outboard of the longitudinal side edges of opening 63, thereby defining a narrow lip or groove along each longitudinal side of opening 63, from lower edge 66 of base portion 60. This arrangement is most clearly shown in FIG. 4.

In the embodiment shown, mateable section 62 is sufficiently elevated from the upper surface of base portion 60 that mateable portion 30 from the lower sliding section can readily fit into the shallow longitudinal grooves between base portion 60 and mateable portion 62 and to easily slide therein. The free end of mateable portion 30, upon reaching the end of the opening 63, can continue to move forwardly between the outer surface of base portion 60 and the inner surface of mateable portion 62.

Approximately mid-length of mateable portion 62 in the upper surface thereof is a shallow lateral groove 68. At the bottom of groove 68 is a lateral opening 70 which is similar in size and configuration to slot openings 32 in mateable portion 30. Opening 70 is arranged so that the openings 32 in mateable portion 30 can be brought into registry therewith, when mateable portion 30 has been inserted into mateable portion 62, through sliding action of the slidable sections 20 and 58. In addition to opening 70, there are two smaller openings 72 and 74 in groove 68, near the respective edges 73, 75 thereof. Fitting into groove 68 is a latch element 76 which is hinged on one end 78 thereof to mateable portion 62 in the vicinity of one longitudinal edge thereof. On the lower surface of latch 76 is a raised element 80 which is configured to fit through opening 70 in mateable portion 62 and into a matching slot 32 with a pressure fit in mateable portion 30. Raised elements 82 and 84 are designed to fit through openings 72 and 74 in mateable portion 62, to provide a locking (snap) capability of the latch relative to mateable portion 62.

In operation, mateable portion 30 from the lower slidable section fits into the space between mateable portion 62 and the base portion 60 of upper slidable section, thereby providing an adjustable length capability for the protective guard of the present invention, depending upon the spaced relationship of the two slidable sections. In the embodiment shown, there is approximately a three-inch range of movement. This amount of adjustability will be sufficient to provide for almost all the variances in size of ordinary users. A motion limiting arrangement, comprising a slot 65 in the lower mateable section 30 and an associated trapping screw or bolt, which extends through the lower surface of groove 68 into slot 65, ensures that the relative movement of the two sections is maintained in the desired range.

In order to fix the length of the guard, the two sections are moved relative to each other until the overall correct length of the guard is achieved. At that point, a slight adjustment may be made so that a slot 32 fits directly beneath opening 70. The latch 76 is then moved so that raised element 80 fits through opening 70 and into mating slot 32, thereby locking the two slidable sections in place relative to one another. The other two raised elements are press-fit into their associated openings 72 and 74 for a locking effect. When it is desired to change the length of the guard, it is only necessary to move the latch element 76 about its hinge, away from the groove, move the two slidable sections toward or away from each other to achieve the desired length, and then reposition the latch 76 into the groove. When the two sections are extended to a long length position, there will be a gap between protective pads 16 and 52. Accordingly, base portion 60 of the upper slidable section is made somewhat wider than a normal leg guard.

Figure 5:
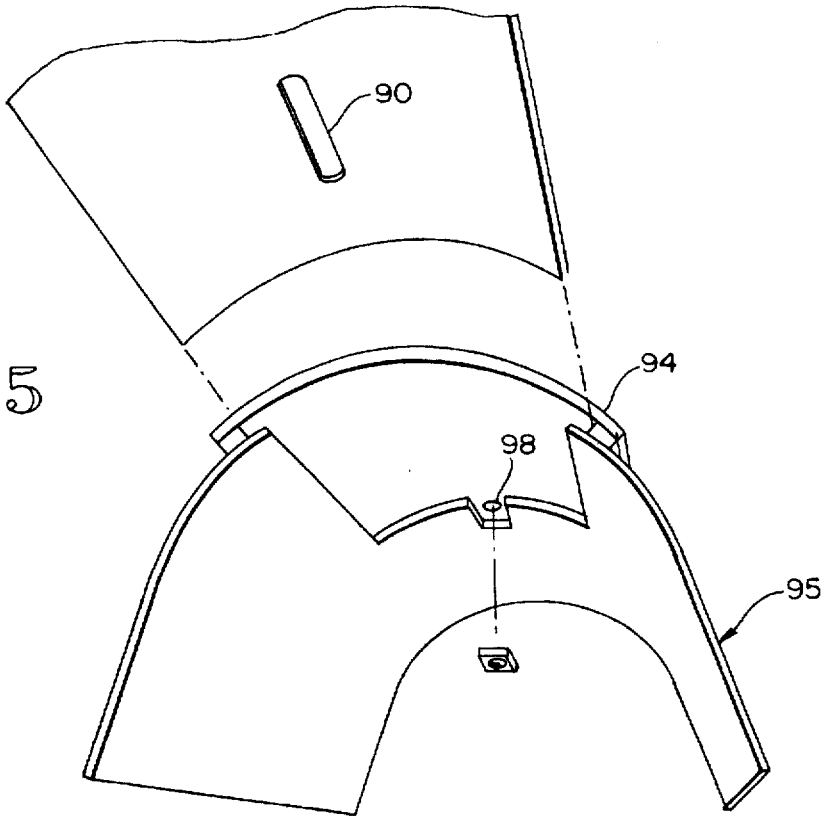
FIG. 5 is a partial perspective view showing a portion of another embodiment of the present invention.

FIG. 5 shows an alternative embodiment of the present invention. This embodiment is similar in all respects to the embodiment of FIGS. 1–4 except that the plurality of lateral or transverse slots 32 in lower mateable section 88 are replaced by a single longitudinal slot 90. In upper mateable portion 94 of the upper slidable section 95 is an opening 98 for a bolt or the like. The bolt fits through the opening 98 and through slot 90 in the mateable portion 88. A nut 99 is captured in the lower surface of base portion 100 into which the free end of the bolt is screwed. To adjust the length of the guard, the bolt is loosened so that the lower slidable section may be moved to the desired position, at which point the bolt is again tightened into the nut, holding the two portions in the desired relationship.

Accordingly, the present invention retains all of the advantages of conventional full length leg guards, but includes the capability of changing the length of the guard. The length can be changed readily, typically without the aid of special tools. The relative position of the two sliding section is maintained under actual playing conditions.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. An adjustable protective guard for legs, comprising:

a lower protective portion, configured and adapted to protect ankle and shin portions of the leg of the user;

a first adjustable portion, configured and adapted to protect a lower portion of the leg of the user;

flexible means connecting the lower protective portion to the first adjustable portion;

an upper protective portion for the knee and surrounding area of the user;

a second adjustable portion configured and adapted to protect a portion of the leg from the first adjustable portion to the upper protective portion, wherein the first and second adjustable portions include, respectively, mating means permitting the two adjustable portions to be secured together at varying relative positions such that the length of the protective guard can be adjusted, wherein the mating means for the first adjustable portion includes an extending member which is narrower than the first adjustable portion and extends beyond an upper edge thereof, mating with the mating means on the second adjustable portion; and protective pads attached to an inner surface of both the first adjustable portion and the second adjustable portion, wherein at least one of the pads does not extend for the full length of its attached adjustable portion, so that the first and second adjustable portions can adjust in length while overlapped over a selected distance without the protective pads overlapping.

2. An apparatus of claim 1, wherein the extending member on the first adjustable portion has a plurality of openings located therein and wherein the mating means on the second adjustable portion is adapted and configured to receive said extending member and has at least one opening therein, such that the openings in said extending member successively come into registry with said opening in the mating means on the second mating portion, as the first and second adjustable portions move relative to each other, and wherein the second adjustable portion includes a locking element which fits through said opening and into said slot, locking the two adjustable portions in place.

3. An apparatus of claim 2, wherein the locking element is a latch which is hingedly connected to the second adjustable portion.

4. An apparatus of claim 1, wherein the extending member has a longitudinal slot therein, and wherein the mating means on the second adjustable portion has an opening therein to receive an attaching element which in use of the article extends through said opening and said slot and which can be tightened so as to fixedly position the two adjustable portions relative to each other.

5. An apparatus of claim 4, wherein the attaching element is a threaded bolt, the free end of which fits into a matching nut which is captured in the second adjustable portion beneath the extending portion of the first mating portion.

6. An apparatus of claim 1, wherein the extending member is secured to an outer surface of a base portion of the fist adjustable portion, and wherein the mating means on the second adjustable portion is positioned slightly above an outer surface of a base portion of the second adjustable portion, so that there is sufficient space between the mating means on the second adjustable portion and the base portion and the second adjustable portion to permit slidable entry of said extending portion therein.

7. An apparatus of claim 1, wherein the apparatus further includes straps which extend around the leg to hold the apparatus in place.

* * * * *